United States Patent [19]

Sato

[11] 4,037,458

[45] July 26, 1977

[54] SILENCING METHOD AND SILENCER DEVICE IN CRANK PRESS MACHINE

[76] Inventor: Fumio Sato, 2855-1, Nishifuzi cho, Onomichi, Hiroshima, Japan

[21] Appl. No.: 661,683

[22] Filed: Feb. 26, 1976

[30] Foreign Application Priority Data

Mar. 4, 1975 Japan ..... 50-26886

[51] Int. Cl.[2] ..... B21J 9/20

[52] U.S. Cl. ..... 72/429; 72/441; 72/450

[58] Field of Search ..... 72/429, 450, 441, 443, 72/449; 74/409; 83/617, 615; 100/257, 259, 282

[56] References Cited

U.S. PATENT DOCUMENTS 3,485,109 12/1969 Dunlap ..... 74/409

FOREIGN PATENT DOCUMENTS 465,352 8/1951 Italy ..... 72/450

*Primary Examiner*—C.W. Lanham
*Assistant Examiner*—Gene P. Crosby
*Attorney, Agent, or Firm*—Willian Anthony Drucker

[57] ABSTRACT

This invention provides a method and device for eliminating vibration and for silencing noise caused during operation of a crank-driven press tool. A brake operates on the crank shaft of the press tool from just before to just after the termination of the press stroke, thereby preventing the kinetic energy of the mechanical components and metal mold from being reduced instantaneously to zero and thus preventing the generation of vibration and noise usually occurring during press work in a crank-driven press tool.

6 Claims, 10 Drawing Figures

SILENCING METHOD AND SILENCER DEVICE IN CRANK PRESS MACHINE

BACKGROUND OF THE INVENTION

The high levels of noise caused during press work by a crank-driven press has a bad influence on the health of people who live nearby a workshop, and is also liable to make operators hard of hearing.

Hitherto, to solve these problems in conventional manner, it has been suggeste that the workshop is removed to an isolated zone, or soundproof walls are provided around the workshop. However, these are attempted cures, rather than preventive methods to keep the health of the operators and other people who live nearby the workshop.

It has been made clear through my research that in shock noise caused by and/or during press work, there are two kinds of noise, one being operational noise which is caused when working materials, and the other being vibration noise which is caused by the backlash produced when the momentum (kinetic enery) of the mechanical components and the metal mold is instantaneously reduced to zero. The latter vibration noise usually represents more than half of the total noise level issuing from a crank press machine. The method and device disclosed by this invention may accordingly effectively silence and eliminate the operational noise of a crank-driven press machine by actuating a brake means to prevent the momentum of components and metal mold from being instantaneously reduced to zero.

OBJECTS OF THE INVENTION

A primary and important object of the present invention is to improve the working atmosphere of operators of crankdriven press machines by greatly lessening shock noise caused during the running of said crank-driven press machines.

Another important object of the present invention is to reduce or eliminate vibration and noise of said crank-driven press machines affecting people who live nearby a workshop.

Still another important object of the present invention is to eliminate lowering of accuracy of metal molds and the crank-driven press machine itself, and to prevent said components and metal molds of said crank-driven press machine from being damaged or injured.

These and other objects are accomplished by the improvements, combinations and arrangements of features comprising the invention, a preferred embodiment of which is shown by way of example in the accompanying drawings, and which is hereinafter described in detail. Various modifications and changes in details of construction are comprehended within the scope of the appended claims.

DESCRIPTION OF THE PREFERRED EMBODIMENT

Figure 1:
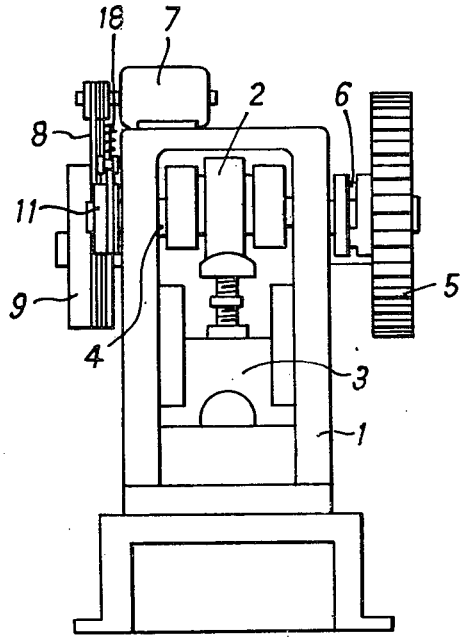
FIG. 1 is a front elevational view of a crank-driven press machine including a device disclosed by the present invention.
Figure 2:
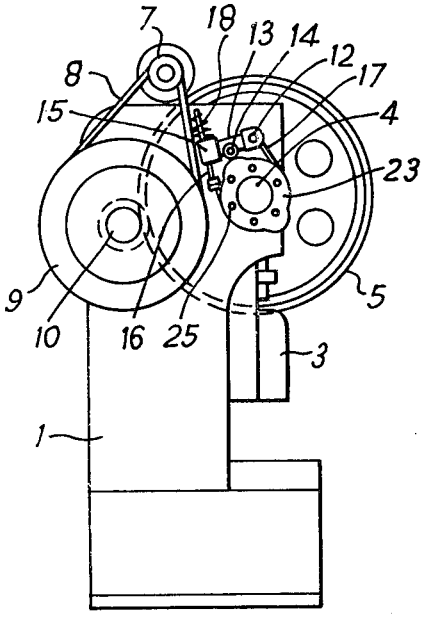
FIG. 2 is a side elevational view of FIG. 1.

Referring to FIG. 1, a crank-driven press machine body is designated generally by reference numeral 1, and a crank provided in the said machine body is shown by the numeral 2. A slide 3 slides vertically and is moved by said crank 2. Numeral 4 designates a crank shaft.

A reduction gear 5 is so arranged that it is connected with said crank shaft 4 by means of a clutch 6. A drive motor rotates a fly wheel 9 by belt means 8. Said crank shaft 4 is rotated via said reduction gear 5 by engagement of said reduction gear 5 with a gear 10 mounted on a shaft of said fly wheel 9.

The above construction is the same as that of the conventional crank-driven press machine. However, in the crank-driven press machine embodying this invention, a brake is provided for safety to avoid unexpected fall of said slide 3 when said crank 2 lifts said slide 3 upwards. Moreover, said brake is constructed in such a manner that it can operate on said crank shaft for braking purpose from a point just before to a point just after the termination of press work, as said slide moves down for the press operation. In this preferred embodiment of the present invention, said crank shaft 4 projects through said machine body 1 at the side opposite to that provided with said clutch 6. A brake drum 11 is mounted on said projecting end of said crank shaft.

A support axis 12 is mounted on the machine frame at the side on which said brake drum 11 is mounted. A brake actuation rod 13 is supported by said support axis 12. The length of said brake actuation rod 13 is made almost equal to the diameter of said brake drum 11, and a rotatable roller means 14 is provided on the inside lower face of said brake actuation rod 13. The free end of said brade actuation rod has a cylindrical portion 15 through which a pull rod 16 is inserted.

Figure 3:
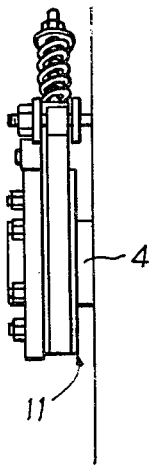
FIG. 3 is a front elevational view of a cam device embodying the present invention.
Figure 4:
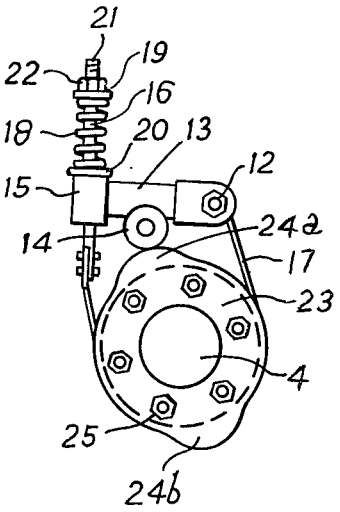
FIG. 4 is a side view of said cam device.

A brake band is designated by numeral 17 in FIGS. 3 and 4, and one end of said band is mounted on said brake actuation rod 13 at the side of said support axis 12, and the other end is mounted on the lower end of said pull rod 16. A spring 18 is mounted between washers 19 and 20 at the upper portion of said pull rod 16 extending through said cylindrical portion 15. The top portion of said pull rod 16 is provided with a male-threaded portion 21 with which a nut 22 is engaged. When said spring 18 is compressed between said washers 19 and 20 by tightening said nut 22, said pull rod 16 is lifted and said brake band 17 is tensioned.

A cam 23 is provided with projecting camming portions **24*a* and 24*b* at diametrically opposed positions. Said cam is fixed by anchor bolts 25 on the side of said brake drum 11 and is contacted by said rotatable roller 14 mounted on said brake actuation rod 13**.

In this invention, one of the projecting portions **24*a* and 24*b* provided on said cam is arranged in such a manner that the brake may operate on said crank shaft for braking purpose in order to avoid unexpected fall of said slide 3 when said slide is lifted upwards, and the other is arranged in such a manner that the brake may operate on said crank shaft for braking purpose from a point just before, to a point just after, the termination of the pressing operation as said slide 3** moves downwardly for its working stroke.

Figure 5A:
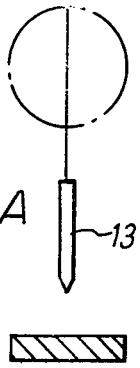
FIGS. 5A, 5B, 6A, 6B, 7A and 7B are schematic views to explain operation of the device, and showing the relationship between said cam device and a crank shaft.
Figure 5B:
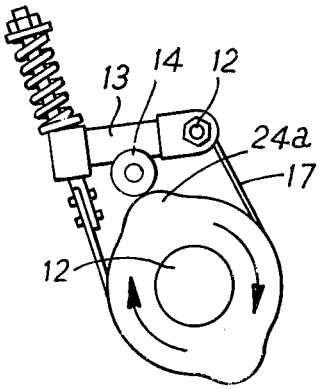
Figure 6A:
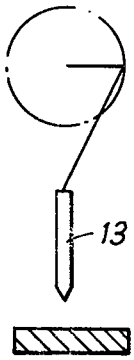
Figure 6B:
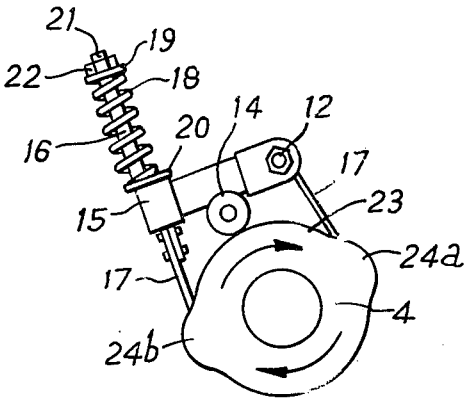
Figure 7A:
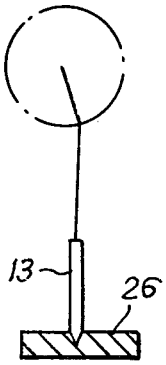
Figure 7B:
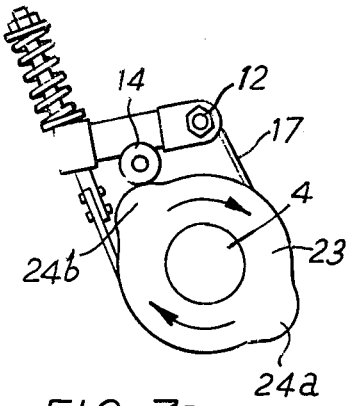

Referring to FIGS. 5, 6 and 7, the actuation of said cam is now explained in detail. In each drawing, portion A illustrates the movements of said crank and said slide in the imitation manners, and portion B illustrates the operating state of said cam and said brake actuation rod.

FIG. 5 shows a state when said slide 3 is lifted. Said brake actuation rod 13 is raised by engagement of said projecting cam portion 24*a* of said cam 23 with said roller 14 as it is turned in clockwise direction about said support axis 12. Said brake band 17 is therefore tensioned so that said brake drum 11 is clamped and said crank shaft 4 is braked.

FIG. 6 shows a state in which said slide 3 is moving down for the press stroke. Said roller 14 comes off said projecting portion 24*a*, thereby no longer causing any braking function.

FIG. 7 shows a state just before the termination of the pressing stroke for a material element 26 as said slide 3 moves down. As clearly shown in this figure, said roller 14 comes into contact with said other projecting cam portion 24*b* of said cam 23, and said brake actuation rod 13 is again lifted and is turned in clockwise direction, whereby said brake band 17 is tensioned and said crank shaft 4 is braked.

In the device disclosed by the present invention, the braking force is variable by changing the pressure of said spring 18 by tightening or loosening said nut 22. On the other hand, even if the spring pressure is always fixed, the braking force is also variable by changing the height of said projecting portions 24*a* and 24*b* of said cam 23, and the braking force can be changed and adjusted differently at each breaking point by differently changing the height of said projecting portions.

In this invention, the braking force, caused by said projecting cam portion 24*b*, which operates on said crank shaft from just before to just after the termination of the pressing stroke, is such that the necessary braking force can be turned as backlash into normal rotation. In the conventional machine, the braking force is about 0.5 to 20% of the load capacity of a press machine, and it is preferably 0.5% to 5%. Therefore, the height of said projecting cam portion is so designed that this degree of braking force may be provided in a press machine. If the service frequency of a press machine is high and if the working accuracy of said machine becomes worse and worse, the braking force is set to a greater degree. The braking point is usually from just before to just after the termination of the pressing stroke. However, as the braking point is different according to the kind, size and shape of a workpiece, the position of the projecting cam portions is suitably selected on the cam.

In this preferred embodiment of the invention, there is a device in which a brake drum is mounted on a crank shaft and a brake is actuated by a combination of brake actuation rod and brake band. However, the present invention is not limited only to this preferred embodiment. A brake disc may be used instead of a brake drum, and the device disclosed by this invention can be of either vertical type or horizontal type.

By constructing the device of the present invention, as shown and described above, the brake operates on the crank shaft just before to just after the termination of the pressing stroke, the kinetic energy of the machine body and the metal molds is prevented from being reduced instantaneously to zero at the termination of the pressing stroke, thereby silencing and eliminating the vibrational noise usually caused in such press work.

The excellent working effects of the device embodying the present invention are clear from results of measurements, described hereinafter, that have been carried out by the Machine & Engineering Research Institute of Japanese Industrial Engineering Bureau.

In both a 35 - ton press machine having a cast iron frame, which has been used for about 10 years, and a 60 - ton press machine having a cast iron frame, which has been used for about 3 years, the noise level has been measured separately in idle run and loaded run (press work).

In the case of the 35 - ton press machine, the noise level had been 99 decibels (db) in AF value ( in phons usually employed for measurement of noise level) and 105 decibels (db) in A1 value on loaded run (with load of 30 tons) when a silencer device embodying the present invention was not employed, but the noise level had been reduced to 82 decibels in AF value and 86 decibels in A1 value when the silencer device was employed in said press machine. Namely, the noise was reduced by about 17 19 decibels.

In the case of the 60 - ton press machine, the noise level, when said silencer device was not employed in said press machine, had been 101 to 103 decibels (db) in AF-value and 109 to 110 decibels in A1-value on loaded run (with load of 55 tons), but when said silencer device was employed, only 83 to 84 decibels in AF-value and 87 decibels in A1-value. Namely, the noise level had been greatly reduced by 17 to 23 decibels by employing said silencer device embodying the present invention. On the other hand, the noise level had been 92 to 93 decibels in AF-value and 98 decibels in A1-value on non-actuation of said silencer device, but 83 decibels in AF-value and 90 decibels in A1-value on actuation of said silencer device. In particular, the noise level on a loaded run (when said silencer device was employed) was lower by 3 decibels in A1-value than that on an idle run. Moreover, the noise level in both AF and A1 values on a loaded run (when said silencer device was employed) was lower than that on idle run when said silencer device was not actuated.

Having thus described by invention, what is claimed as new and desired to be secured by Letters Patent is:

1. In a crank-driven press having a machine frame, a crankshaft rotatable in said frame, a press tool coupled to the crank of said crankshaft and driven thereby in a pressing stroke, the improvement which comprises:

i. brake means on said machine frame to act on said crankshaft, and ii. cam means driven in synchronism with said crankshaft and coacting with said brake means so as to cause said brake means to brake said crankshaft during a period commencing shortly before and terminating shortly after said press tool terminates its pressing stroke, thereby to reduce vibration and noise of operating said press.

2. In a crank-driven press, as claimed in claim 1, said cam means being a radial cam having diametrically opposed symmetrical cam projections.

3. In a crank-driven press, as claimed in claim 2, said brake means including (a) a brake drum on said crankshaft, (b) a brake actuation rod pivoted on said machine frame, (c) a brake band connected at one end to said machine frame and at the other end to said brake actuation rod, and (d) a cam follower roller journalled on said brake actuation rod and contacted by said radial cam.

4. In a method of operating a crank-driven press having a crankshaft with a crank connected to a press tool for moving said press tool in a pressing stroke, the steps of:

i. rotating said crankshaft to move said press tool into and then out of a terminal position of a pressing stroke ii. applying a braking force to said pressing tool throughout a period commencing shortly before the press tool reaches said terminal position and terminating shortly after the press tool leaves said terminal position.

5. The method claimed in claim 4 wherein said braking force is about 0.5 to 20% of the load capacity of the press.

6. The method claimed in claim 4 wherein the braking force is 0.5 % to 5% of the load capacity of the press.

* * * * *